US012507833B2

(12) United States Patent
Meyers et al.

(10) Patent No.: US 12,507,833 B2
(45) Date of Patent: Dec. 30, 2025

(54) SHOWER CURB SYSTEM

(71) Applicant: EBBE AMERICA, LC, Clearfield, UT (US)

(72) Inventors: Lawrence G. Meyers, Clearfield, UT (US); Alden S. Meyers, Clearfield, UT (US)

(73) Assignee: EBBE AMERICA, LC, Clearfield, UT (US)

( * ) Notice: Subject to any disclaimer, the term of this patent is extended or adjusted under 35 U.S.C. 154(b) by 454 days.

(21) Appl. No.: 18/198,660

(22) Filed: May 17, 2023

(65) Prior Publication Data

US 2023/0380637 A1 Nov. 30, 2023

Related U.S. Application Data

(60) Provisional application No. 63/345,305, filed on May 24, 2022.

(51) Int. Cl.
*A47K 3/30* (2006.01)

(52) U.S. Cl.
CPC ..... *A47K 3/30* (2013.01); *A47K 2003/305* (2013.01)

(58) Field of Classification Search
CPC . A47K 3/40; A47K 3/30; A47K 3/405; A47K 3/305; A47K 3/34; A47K 2003/305
USPC ..... 4/612
See application file for complete search history.

(56) References Cited

U.S. PATENT DOCUMENTS

| | | | | |
|---|---|---|---|---|
| 6,895,714 | B2 | 5/2005 | Teubert et al. | |
| 8,141,183 | B2 | 3/2012 | Cook | |
| 9,743,809 | B1 | 8/2017 | Shaukat et al. | |
| 9,770,139 | B2 | 9/2017 | Cook | |
| 10,028,623 | B1 | 7/2018 | Smith et al. | |
| 10,182,684 | B2 | 1/2019 | Davis, Jr. | |
| 10,927,545 | B2 | 2/2021 | Von Hoyningen Huene et al. | |
| 2010/0293708 | A1* | 11/2010 | Hildebrandt | A47K 3/40 409/131 |
| 2016/0206157 | A1* | 7/2016 | Ball | A47K 3/34 |

FOREIGN PATENT DOCUMENTS

CN 209678342 U 11/2019

* cited by examiner

*Primary Examiner* — Lauren A Crane
(74) *Attorney, Agent, or Firm* — Workman Nydegger

(57) ABSTRACT

A shower curb system for installation in a shower area includes an anchor member and a curb member. The anchor member is arranged for attachment to a subfloor. The curb member is installable on the anchor member to selectively lock the curb member to the anchor member. The curb member forms a flow barrier between a wet floor area and a dry floor area of the shower area. The curb member defines an internal cavity including a top opening. The internal cavity is configured to receive one or more glass members via the top opening such that curb member at least in part locates and supports the one or more glass member in the shower area.

20 Claims, 9 Drawing Sheets

SHOWER CURB SYSTEM

TECHNICAL FIELD

The disclosure relates to a shower curb system for improved installation in a shower area.

BACKGROUND

In wet floor areas such as tiled showers, cracks in tile and grout lines can allow water through the finishes, even when those finishes are not submerged. Shower curbs are especially problematic because they are commonly framed in wood and then covered in tile. The wood is known to shrink and expand with time and changes in humidity. Such dimensional changes can generate visible and invisible cracks in the grout and or tiles. This can be problematic because shower curbs are the flow barrier on the outer edge of the wet floor area and are meant to prevent water from seeping out of the shower. Cracks in the grout or tile on a shower curb can result in unseen and costly leakage, mold, and structural damage to both the wet floor area and dry floor areas outside of the shower.

Another problem with shower curbs is they are not constructed to work with glass. Glass members are typically screwed into a wall above the shower curb and then adhered to the top of the shower curb after the shower curb is tiled and finished. This can result in shower installations that are not aesthetically pleasing and faulty due to installer errors in centering or adhering the glass members to the shower curb.

Accordingly, there is a need for a shower curb system that incorporates certain design improvements over other systems for streamlined and improved installation in a wet floor area.

SUMMARY

Embodiments of the present disclosure advantageously provide a shower curb system that incorporates certain design improvements over other systems for streamlined and improved installation of the system in a shower floor. Moreover, the shower curb systems and related methods of the present disclosure provide improved positioning and attachment of a shower curb and one or more glass members in a shower area. The disclosed embodiments provide a shower curb system that is more accurate and more efficient in installation, more durable, more waterproof, and less prone to failure than prior art systems, such as prior art systems requiring a tiled shower curb.

According to an embodiment, a shower curb system is provided for improved installation in a shower area. The shower curb system may comprise an anchor member arranged for attachment to a subfloor and a curb member installable on the anchor member to selectively lock the curb member to the anchor member. The curb member may be arranged to form a flow barrier between a wet floor area and a dry floor area of the shower area. The curb member may define an internal cavity including a top opening, the internal cavity configured to receive one or more glass members via the top opening such that the curb member at least in part locates and supports the one or more glass members in the shower area.

In another embodiment, a shower curb system is provided for improved installation in a shower area. The shower curb system may comprise an anchor member arranged for attachment to a subfloor, a curb member installable on the anchor member to selectively lock the curb member to the anchor member, and a cap member removably positionable in a top opening of the curb member adjacent to one or more glass members.

Embodiments of the current disclosure may comprise methods of installing an improved shower curb system. Such a method may comprise providing an anchor member to a subfloor and installing a curb member on the anchor member to selectively lock the curb member to the anchor member. The curb member may be arranged to form a flow barrier between a wet floor area and a dry floor area of the shower area, wherein the curb member defines an internal cavity including a top opening and the internal cavity configured to receive one or more glass members via the top opening such that the curb member at least in part locates and supports the one or more glass members in the shower area.

BRIEF DESCRIPTION OF THE DRAWINGS

These and other features, aspects, and advantages of the present disclosure will become better understood regarding the following description, appended claims, and accompanying drawings.

Figure 1:
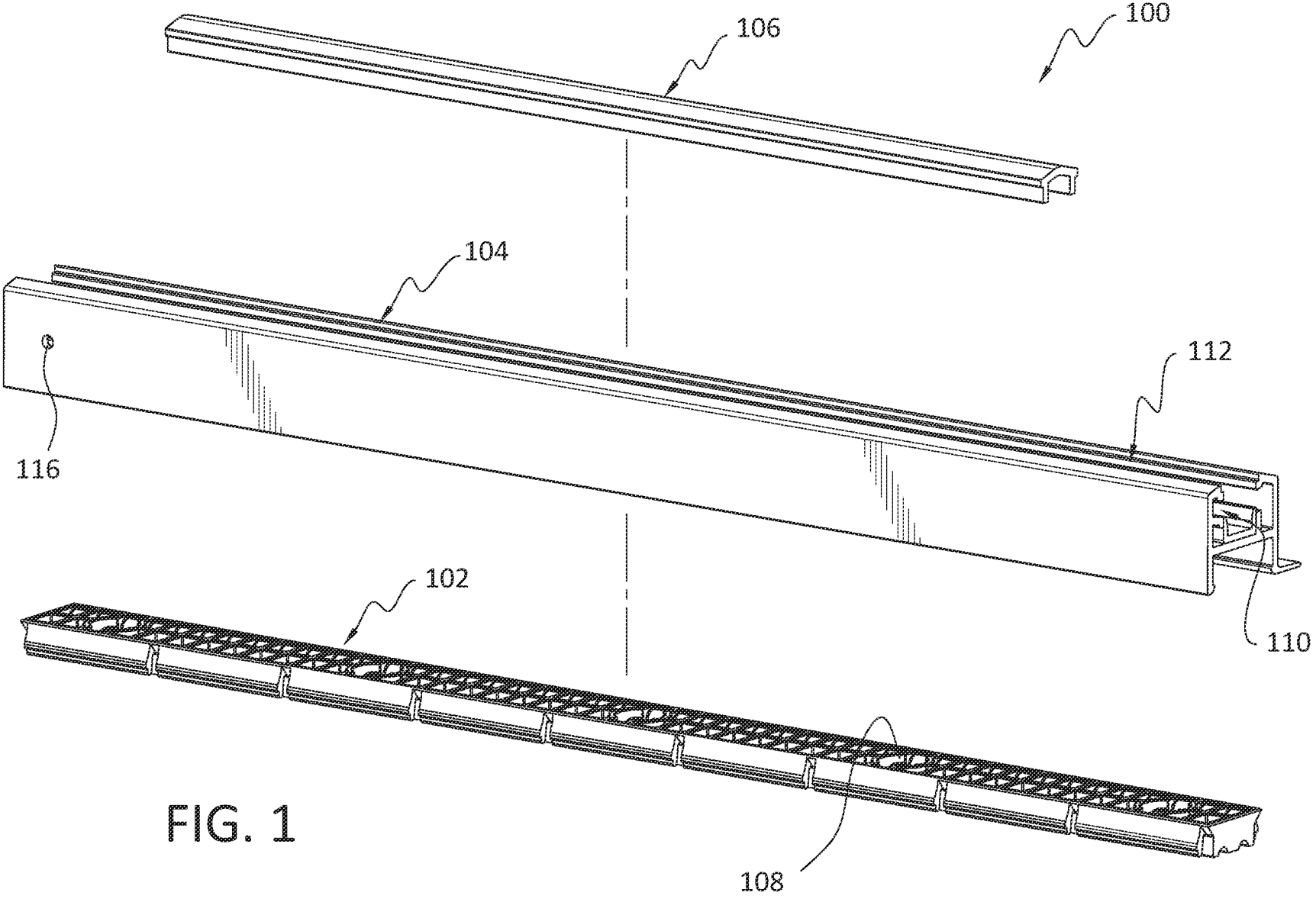
FIG. 1 shows an exploded view of a shower curb system according to an embodiment.

The drawing figures are not necessarily drawn to scale, but instead are drawn to provide a better understanding of the components, and are not intended to be limiting in scope, but to provide exemplary illustrations. The figures illustrate exemplary configurations of drain systems, and in no way limit the structures or configurations of a drain system and components according to the present disclosure.

DETAILED DESCRIPTION OF VARIOUS EMBODIMENTS

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the intention covers all modifications, alternative constructions, combinations, and equivalents falling within the spirit and scope of the disclosure.

It will be understood that unless a term is expressly defined in this application to possess a described meaning, there is no intent to limit the meaning of such term, either expressly or indirectly, beyond its plain or ordinary meaning.

Embodiments of the present disclosure advantageously provide a shower curb system that incorporates certain design improvements over other systems for streamlined and improved installation of the system in a shower floor. It will be appreciated that the shower floor area described herein can comprise a tile shower floor, a stone tile floor, a wood shower floor, a cultured shower floor, or any other suitable type of shower or wet area floor.

FIGS. 1-6 illustrate a shower curb system 100. As shown in FIG. 1, the shower curb system 100 may include an anchor member 102, a curb member 104, and a cap member 106. The anchor member 102 is configured for attachment to a subfloor in a shower floor area. In an embodiment, the anchor member 102 is attachable to the subfloor via a plurality of fasteners inserted through a plurality of openings 108 defined in the anchor member 102. In varying examples, the fasteners may include, bolts, screws, nails, staples or the like. The anchor member 102 can be formed of stainless steel, nickel, brass, plastic, composite materials and or any other suitable material.

In certain embodiments, the anchor member 102 may form a flow barrier between a wet floor area and a dry floor area of the shower area. For example, the anchor member 102 can be configured and arranged to prevent seepage of water through the anchor member 102 without being framed and tiled over as in the prior art.

The curb member 104 is installable on the anchor member 102 to selectively lock the curb member 104 with the anchor member 102 and to secure the position of the curb member 104 in the shower area entry or exit. The curb member 104 forms a flow barrier between a wet floor area and a dry floor area of the shower area. For example, the curb member 104 can be constructed and formed of a material arranged to prevent seepage of water through the curb member 104 without being framed and tiled over as in the prior art. In an embodiment, the curb member 104 can be formed of stainless steel, nickel, brass, plastic, composite materials and or any other suitable material.

According to one example, the anchor member 102 may be arranged to form a first flow barrier between a wet floor area and a dry floor area of the shower area and the curb member 104 may be arranged to form a second flow barrier between the wet floor area and the dry floor area of the shower area. The arrangement of the anchor member 102 and the curb member 104 may advantageously provide a second threshold above a first threshold, and to the inside and and/or outside of the first threshold, better ensuring control of moisture between a wet area and a dry area of the shower area without the need for a tiled shower curb and its associated drawbacks.

The curb member 104 beneficially streamlines installation of a shower floor (e.g., tile or stone) because an installer does not need to frame and tile the shower curb. It also advantageously reduces the likelihood of leaks and water damage because the curb member 104 does not experience the same dimensional changes as prior art shower curbs that have been framed and tiled.

The curb member 104 is arranged and shaped to blend and fit into a shower floor in an aesthetically pleasing manner, improving the look and feel of the finished tiled shower. The curb member 104 is shown having a substantially linear configuration but can have a curved configuration or any other configuration, such as may be desired to form a boundary of a shower area. The shower curb system 100 can have any suitable length, height, and/or width based on a particular application. For instance, the shower curb system 100 can have a reduced height for a low-profile application.

Referring still to FIG. 1, the curb member 104 defines an internal cavity 110 including a top opening 112 at or near a top of the curb member 104. The internal cavity 110 is configured to receive one or more glass members via the top opening 112 such that the curb member at least in part locates and supports the one or more glass members relative to the curb member 104. This beneficially better integrates the one or more glass members with the shower curb system 100 and reduces the likelihood of glass installation mistakes because the curb member 104 both locates and better secures the one or more glass members within a tiled shower. It should be noted that, while referenced as glass for ease of description, the glass members may comprise any suitable glass or glass like material, such as may be employed in a shower.

In an embodiment, the internal cavity 110 can define one or more longitudinal channels 114 (shown in FIG. 2) within the curb member 104. Optionally, one or more side openings 116 can be provided in fluid communication with the longitudinal channels 114 and the wet shower area. If water enters or seeps into the internal cavity 110 via the top opening 112, the water can fill or flow through the longitudinal channels 114 until the water reaches the one or more side openings 116, which can direct the water back into the wet shower area. This beneficially allows the curb member 104 to drain undesirable seepage from the shower curb system 100 onto the wet floor area. In other embodiments, one or more side openings 116 can be threaded and arranged to receive a threaded bolt for positioning the glass members 148 in the internal cavity 110.

The cap member 106 is positionable in the top opening 112 of the curb member 104. The cap member 106 can be removable from the curb member 104 to provide access to the internal cavity 110 for receiving the one or more glass members, and selectively positioned in the top opening 112 adjacent or between the one or more glass members installed in the internal cavity 110. The cap member 106 beneficially helps hide the internal cavity 110, improving the appearance of the shower curb system 100 and making it more comfortable for a user to step onto or over the shower curb system 100. The cap member 106 can be removable from the curb member 104 for cleaning if needed. The cap member 106 can comprise one, two, or three or any other suitable number of sections, and may be formed of stainless steel, nickel, brass, plastic, composite materials and or any other suitable material.

Figure 2:
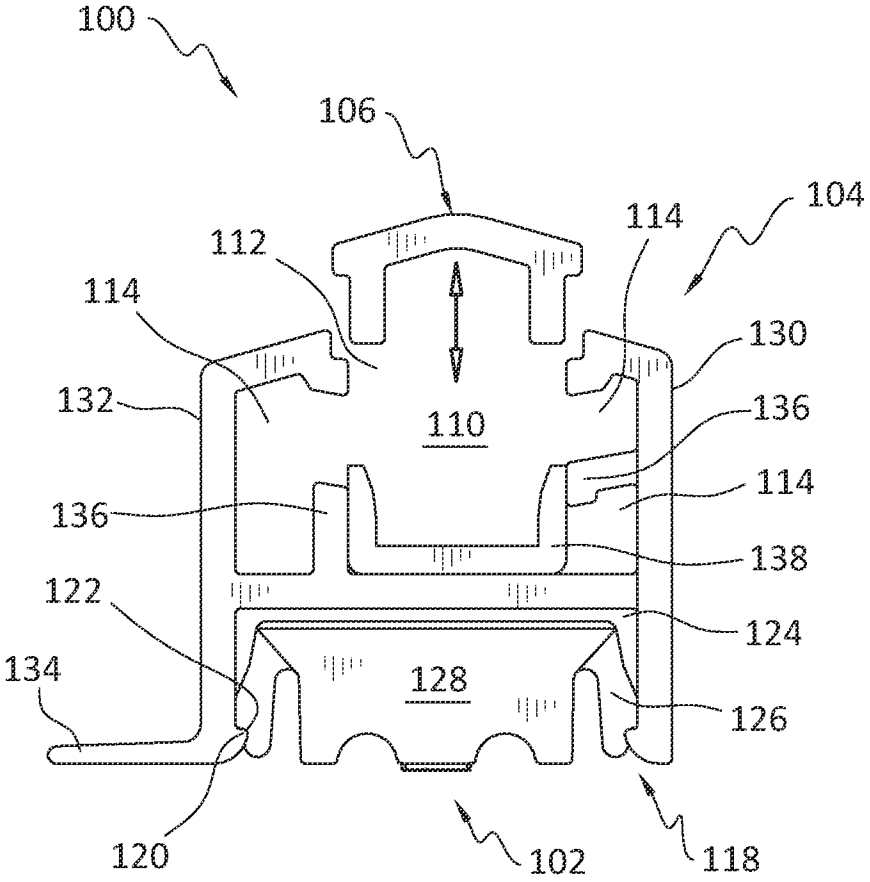
FIG. 2 is a front view of the shower curb system of FIG. 1.

Referring to FIG. 2, the shower curb system 100 can include a locking system 118 to attach the curb member 104 to the anchor member 102 when the curb member 104 is positioned on the anchor member 102. For instance, the locking system 118 can comprise one or more snap lock features. The one or more snap lock features can comprise a plurality of hook portions 120 defined on the curb member 104 that interact with one or more recesses 122 defined on the anchor member 102, or vice versa, to secure the curb member 104 to the anchor member 102 at two, three, four, or any other suitable locations. In other embodiments, the locking system 118 can include male features defined by the curb member 104 and corresponding female features defined by the anchor member 102 or vice versa. The attachment between the curb member 104 and the anchor member 102 can be reversible or irreversible. The arrangement of the locking system 118 advantageously allows for a simple and quick attachment between the curb member 104 and the anchor member 102, without exposing the anchor member 102 or subfloor area to moisture.

In an embodiment, to remove the curb member from the anchor member 102, a force can be applied to the curb member 104 that overcomes the engagement between the one or more snap lock features. It will be appreciated that the size, number, and configuration of the one or more snap lock features can be adjusted to vary the strength of the securement as needed.

In another aspect, the shower curb system 100 can include a plurality of fasteners to attach the curb member 104 to the anchor member 102 when the curb member 104 is positioned on the anchor member 102, such as through one or more side openings 116 that can be threaded and arranged to receive a threaded bolt. In varying examples, the fasteners may include, bolts, screws, nails, staples or the like. Preferably, the locking system 118 and/or the fasteners for attaching the curb member 104 to the anchor member 102 do not allow water to access the anchor member 102 or the subfloor.

The curb member 104 can include a bottom opening 124 sized and configured to accommodate the anchor member 102. The bottom opening 124 and the internal cavity 110 can be separate such that the internal cavity 110 is fluidically isolated from the anchor member 102 when the curb member 104 is attached to the anchor member 102. Advantageously, the arrangement of the curb member 104 can isolate water in the wet area of the shower from fasteners securing and/or penetrating the anchor member 102 and/or the subfloor.

In an embodiment, the hook portions 120 are in the bottom opening 124 and the recesses 122 are defined on elements 126 protruding from a body portion 128 of the anchor member 102. The elements 126 can have a resilient configuration such that when the curb member 104 is forced down on the anchor member 102 the hook portions 120 force the elements 126 toward the body portion. When the hook portions 120 arrive at the recesses 122, the resiliency of the elements 126 forces the elements 126 and the recesses 122 into locking engagement with the hook portions 120, away from the body portion 128, locking the curb member 104 on the anchor member 102.

The curb member 104 can include a first side 130 arranged to interface with the wet floor area and a second side 132 opposite the first side 130. In an embodiment, the curb member 104 can include a foot portion 134 at or near a bottom of the second side 132. The foot portion 134 can help stabilize the curb member 104 on an underlying surface. This beneficially helps prevent the curb member 104 from rocking or rotating when the curb member 104 is positioned on the anchor member 102. The foot portion 134 can also provide a lever for leverage to help remove the curb member 104 from the anchor member 102 during an installation. The foot portion 134 may be secured to the subfloor for added stability and/or strength, such as by the addition of fasteners or the like. In other embodiments, the foot portion 134 can be located on the first side 130.

As discussed above, the curb member 104 defines the internal cavity 110 including the opening 112 configured to receive one or more glass members and support the glass members with the curb member 104. In the illustrated embodiment, the internal cavity 110 includes one or more stabilizing features 136 configured to help keep the glass members toward vertical when they are installed in the curb member 104. The one or more stabilizing features 136 can include a stabilizing arm extending from the first side 130 and a blocking wall extending upward from a bottom of the internal cavity 110. In another aspect, the stabilizing features 136 may include a threaded bolt for positioning the glass members 148 in the internal cavity 110 through the one or more side openings 116, as discussed above with respect to FIG. 1. Optionally, a U-channel 138 can be positioned in the internal cavity 110 for seating the glass members in the internal cavity 110.

The longitudinal channels 114 can run along a length of the curb member 104 and can be located toward the first side 130 and/or the second side 132. In certain embodiments, the longitudinal channels 114 may be angled or otherwise configured for causing water to flow to one or more side openings 116, for draining out of the curb member 104 to the shower area.

Figure 3:
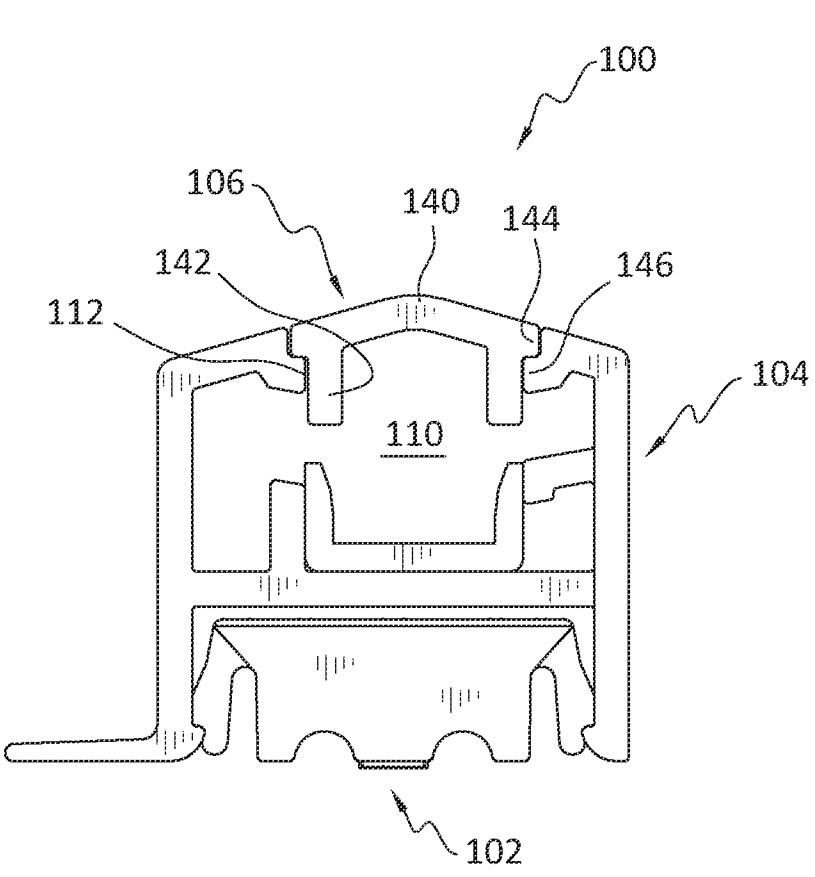
FIG. 3 shows another front view of the shower curb system of FIG. 1.

Referring to FIGS. 2 and 3, the cap member 106 may be removably positionable in the top opening 112. In the illustrated embodiment, the cap member 106 includes a top part 140 and a pair of projections 142 extending downwardly from the top part 140 and defining a pair of overhangs 144. The projections 142 are arranged to extend into the top opening 112 and the overhangs 144 are arranged to engage a pair of corresponding shoulders 146 defined on the curb member 104 to support the cap member 106 on the curb member 104 when the cap member 106 is positioned in the top opening 112. Engagement between the projections 142 and the curb member 104 help prevent the cap member 106 from tipping or rocking when the cap member 106 is positioned in the top opening 112. In certain embodiments, engagement between the projections 142 and the curb member 104 may form a snap fit connection. In additional aspects, the fit between the cap member 106 and the curb member 104 can be such that water can pass therebetween into the internal cavity 110. In other embodiments, the cap member 106 can be sealed in the top opening 112.

When the cap member 106 is positioned in the top opening 112, the top of the shower curb system 100 slopes from the first side 130 and the second side 132 toward a rounded peak of the cap member 106. This advantageously improves foot comfort when the shower curb system 100 is stepped on and directs water falling on the shower curb system 100 between the first side 130 and the peak of the cap member 106 back toward the shower or wet floor area. The peak of the cap member 106 may be configured to be centered under a shower door when the shower door is closed, allowing the arrangement of the shower door and the cap member 106 to prevent water from passing outside the wet area of the shower to the dry area when the door is closed. It will be appreciated that the curb member 104 and the cap member 106 can have other suitable shapes and configurations in other embodiments.

In a variation, the opening 112 may be configured to retentively secure the glass members therein in absence of the cap member 106. For example, a width of the opening 112 may be configured such that the shoulders 146 must expand opposite one another to accommodate a thickness of the glass members and/or of the cap member 106. In this manner, a tight and stable positioning of the glass members and/or the cap member 106 may be realized, using the shoulders 146 as supports and/or as additional supports.

Figure 5:
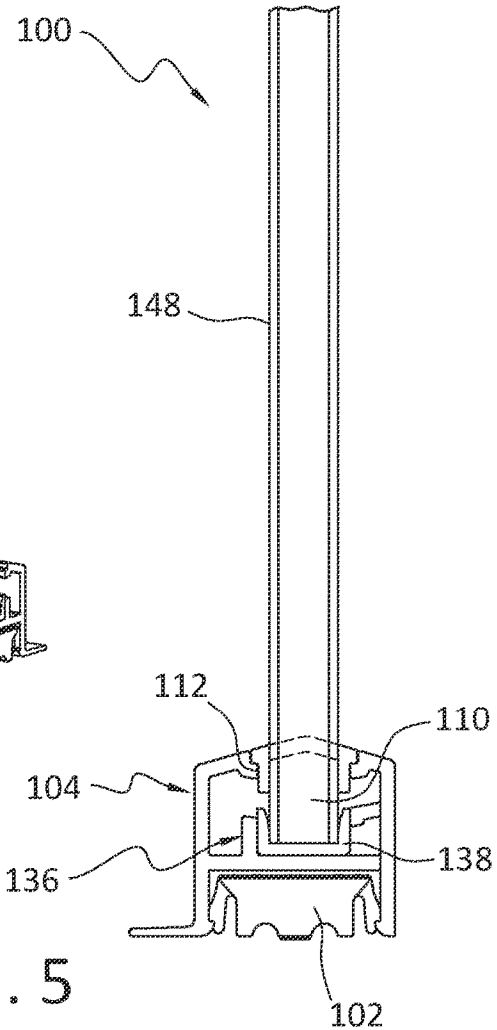
FIG. 5 shows a front view of the shower curb system of FIG. 4.
Figure 4:
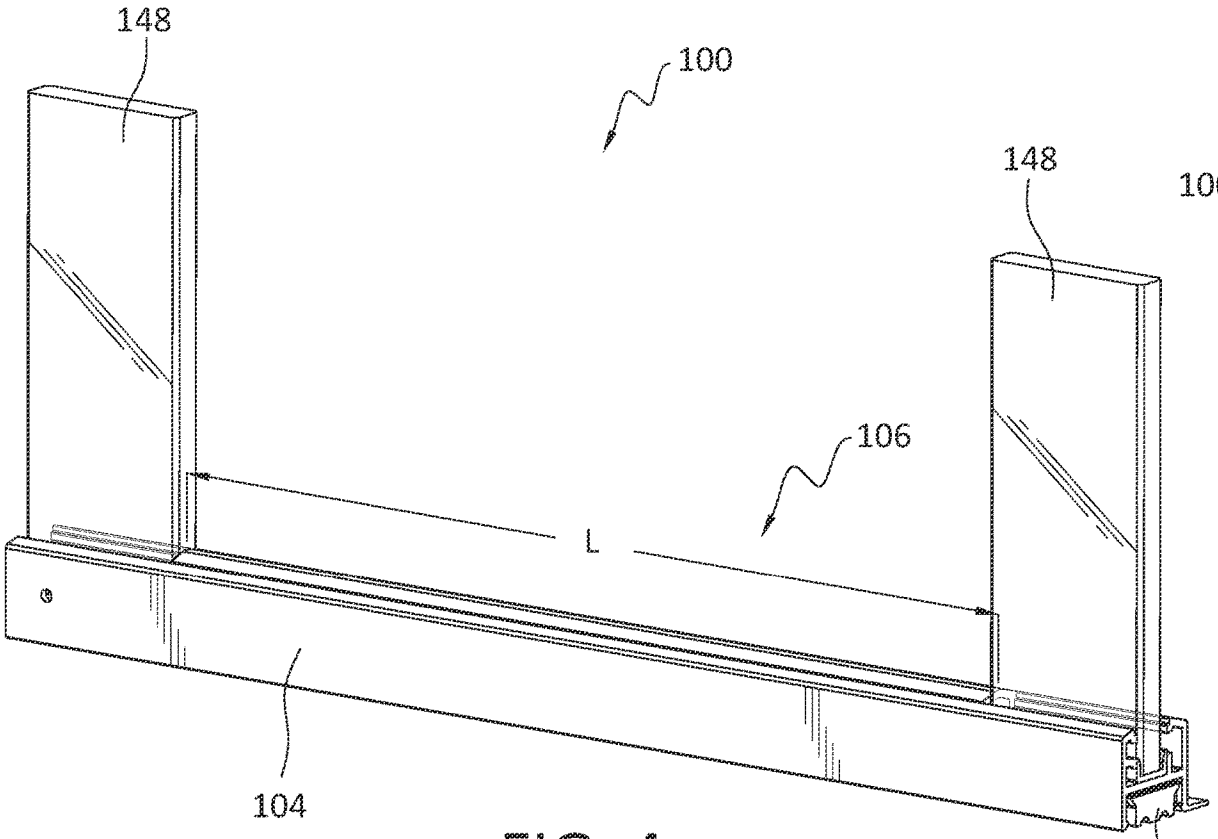
FIG. 4 shows a perspective view of the shower curb system of FIG. 1 including glass members.

FIGS. 4 and 5 illustrate a plurality of glass members 148 installed in the shower curb system 100. As seen, the curb member 104 is locked onto the anchor member 102 and the glass members 148 are received in the internal cavity 110 of the curb member 104 through the top opening 112. The glass members 148 extend into the curb member 104 and are seated in the u-channel 138 located in the bottom of the internal cavity 110. In an embodiment, the u-channel 138 can be adhered to the curb member 104 or be integrally formed therein. In embodiments, the u-channel 138 may comprise a tensioned channel or channels, such as in the form of clips for retentively securing to the glass members 148. In another aspect, the u-channel 138 may comprise a support tray configured to receive the glass members 148 and a sealant and/or adhesive for positioning the glass members 148 in the support tray. The support tray may include holes configured to help capture sealant for positioning the glass members 148 in the support tray. In varying aspects the holes may further improve integration of the glass members 148 in the support tray, such as by improving connection between the sealant and/or adhesive and the tray of the curb member 104.

The glass members 148, the u-channel 138, and the one or more stabilizing features 136 cooperate to help hold the glass members 148 toward a vertical position. Because the glass members 148 integrate with the curb member 104, the curb member 104 centers the glass members 148 relative to the curb member 104 and the glass members 148 cannot detach from a top of the curb member 104. This advantageously helps avoid installation errors and better supports the glass members 148 in a shower. It will be appreciated that the cap member 106 can be selectively sized to fit in the top opening 112 adjacent the glass members 148, covering the top opening 112 beyond the glass members 148. The cap member 106 can have a length L that is preconfigured and or can be cut to length at a job site.

Figure 6:
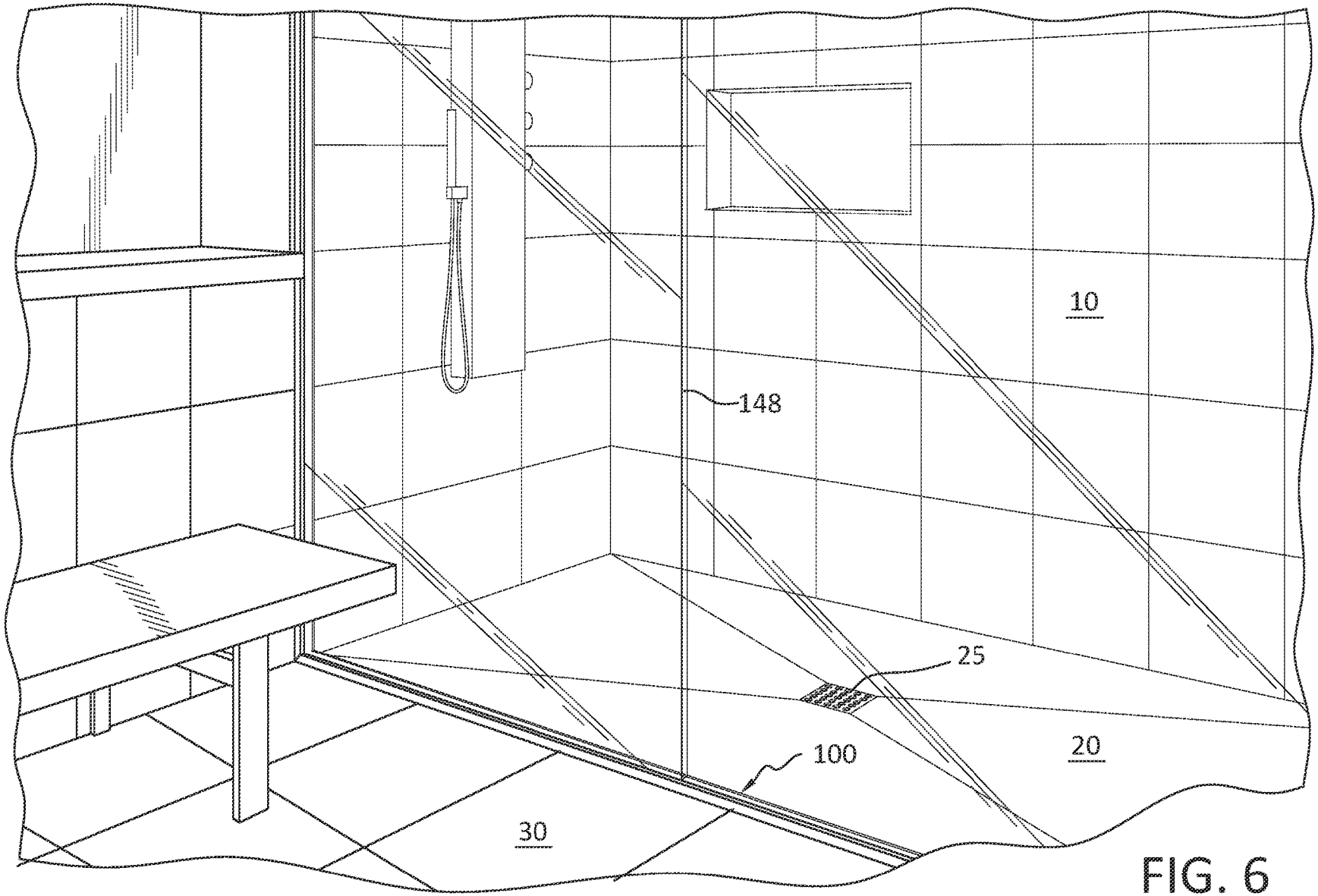
FIG. 6 shows the shower curb system of FIG. 1 installed in a shower floor.

FIG. 6 shows an exemplary installation of the shower curb system 100 in a tiled shower area 10 including a wet floor area 20 with a center drain 25 and a dry floor area 30. As seen, the shower curb system 100 provides a flow barrier between the wet floor area 20 and the dry floor area 30 that blends and fits into the tiled showered area 10 in an aesthetically pleasing manner. The shower curb system 100 streamlines installation because an installer does not need to frame and the tile a shower curb in the shower floor as in the prior art systems. In addition, the glass member 148 can be installed into the curb member 104 rather than being attached to a top of a shower curb after the fact as in prior art systems. It will be appreciated that a height of the shower curb system 100, including the curb member 104, can be varied based on installation needs. For example, the curb member 104 can have a greater height for installation with thicker tiles or a shorter height for installation with thinner tiles. In like manner, the curb member 104 may have a greater height to accommodate a swinging door without the door contacting the tiles of the floor.

Notably, while described with respect to a shower floor, embodiments of the present disclosure are not limited thereto and it should be noted that the shower curb systems described herein may be applied to a floor, wall, and/or ceiling of a shower. In any position, the features of the disclosed embodiments realize an advantageously simple waterproofing barrier and receptor allowing secure attachment of a glass member to a subfloor, wall and/or ceiling.

Figure 8:
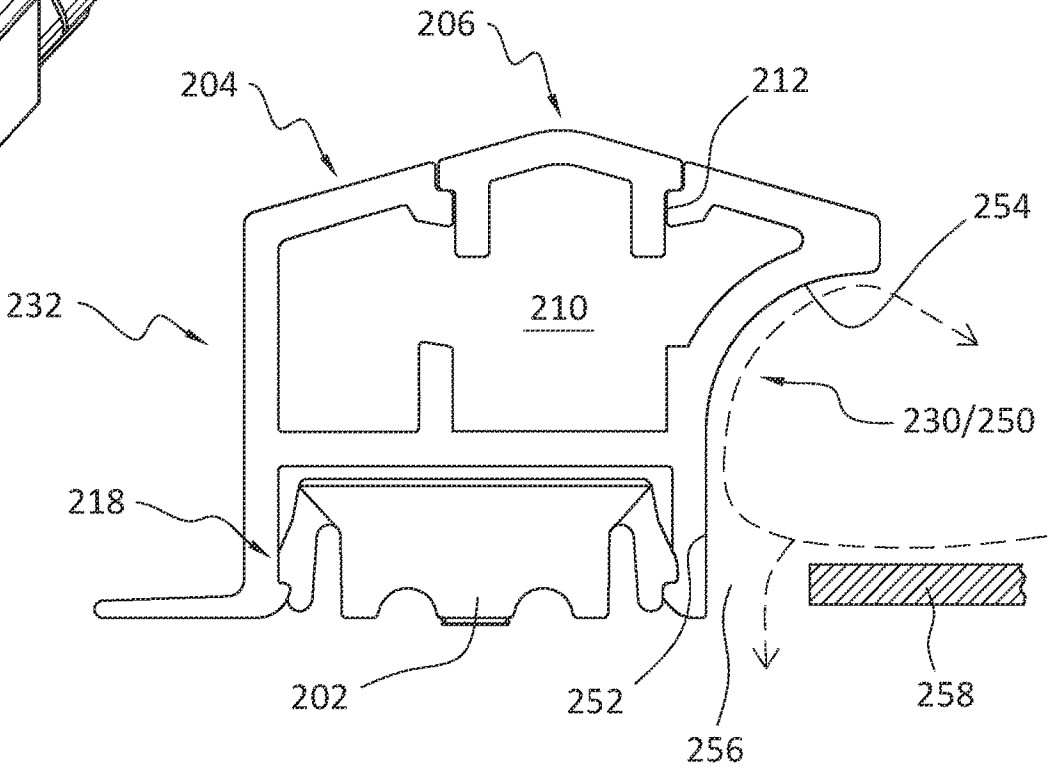
FIG. 8 shows a front view of the shower curb system of FIG. 7.
Figure 7:
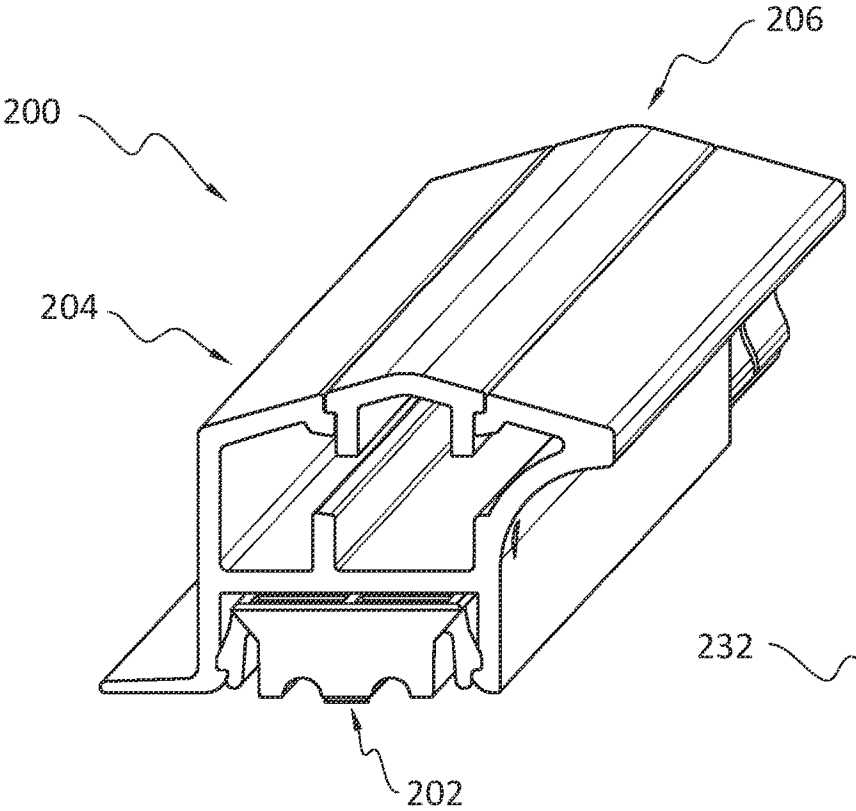
FIG. 7 shows a front perspective view of a shower curb system according to another embodiment.

FIGS. 7-12 illustrate a shower curb system 200 according to another embodiment. It will be appreciated that the shower curb system 200 can have the same or similar features as any of the embodiments described herein. As shown in FIGS. 7 and 8, the shower curb system 200 can include an anchor member 202, a curb member 204, and a cap member 206. The anchor member 202 is configured for attachment to a subfloor in a wet floor area (e.g., shower) entry or exit. The curb member 204 is installable on the anchor member 202 to selectively lock the curb member 204 with the anchor member 202 and to secure the position of the curb member 204 in a shower area entry or exit. Like previous embodiments, the shower curb system 200 can include a locking system 218 to attach the curb member 204 to the anchor member 202 when the curb member 204 is positioned on the anchor member 202.

The curb member 204 defines an internal cavity 210 including a top opening 212 at or near a top of the curb member 204. The internal cavity 210 is configured to receive one or more glass members via the top opening 212 and locate and support the one or more glass members relative to the curb member 204. The cap member 206 is positionable in the top opening 212. The curb member 204 includes a first side 230 arranged to interface with the wet floor area and a second side 232 opposite the first side 230.

The first side 230 can include one or more containment features 250. In an embodiment, the containment features 250 can help contain water in the wet floor area. For instance, the one or more containment features can comprise a lower portion 252 having a planar configuration that transitions to an upper portion 254 extending away from the lower portion 252 toward the wet floor area. The upper portion 254 can curve upward and toward the wet floor area. The lower portion 252 thus forms a flat or nearly flat surface that can abut adjacent grout and or tiles in the wet floor area and the upper portion 254 forms a curved overhang above the tile that can deflect water that runs up the first side 230 back toward the wet floor area. The curved overhang can also dissipate energy in the water, which, in turn, can reduce splashing. This advantageously helps prevent water from escaping from the wet floor area over the top of the shower curb system 200.

In an embodiment, the containment features 250 can help improve the aesthetics of drains installed in a shower floor. For instance, the shower curb system 200 can be installed in a wet floor area of the shower floor such that the upper portion 254 of the first side 230 shadows or tracks along a linear or slotted drain installed in the shower floor. The linear or slotted drain can comprise any suitable linear or slotted drain. Examples of linear or slotted drains can be found in U.S. Pat. Nos. 9,382,701, 9,644,363, and 9,995,032, the disclosure of which is incorporated herein by reference in their entirety.

Because the upper portion 254 curves or turns back toward the wet floor area, the upper portion 254 can sized and a slotted drain opening 256 in a shower floor 258 can be located such that the upper portion 254 extends over and/or above the slotted drain opening 256. This can at least in part conceal or hide the slotted drain opening 256 in the shower floor 258, improving the aesthetics of the shower floor 258. While the one or more containment features 250 are described as a curved overhang, it will be appreciated that the one or more containment features 250 can have other configurations. For instance, the upper portion 254 can extend or turn toward the wet floor area at normal angle or can include multiple angles or curves. In other embodiments, the upper portion 254 can be provided only in a part of the shower curb system, such that the shower curb transitions from a profile of a first side 130 to the profile of a first side 230 or vice versa, for example for covering only an area of a slotted drain opening 256 or the like with containment features 250.

Figure 9:
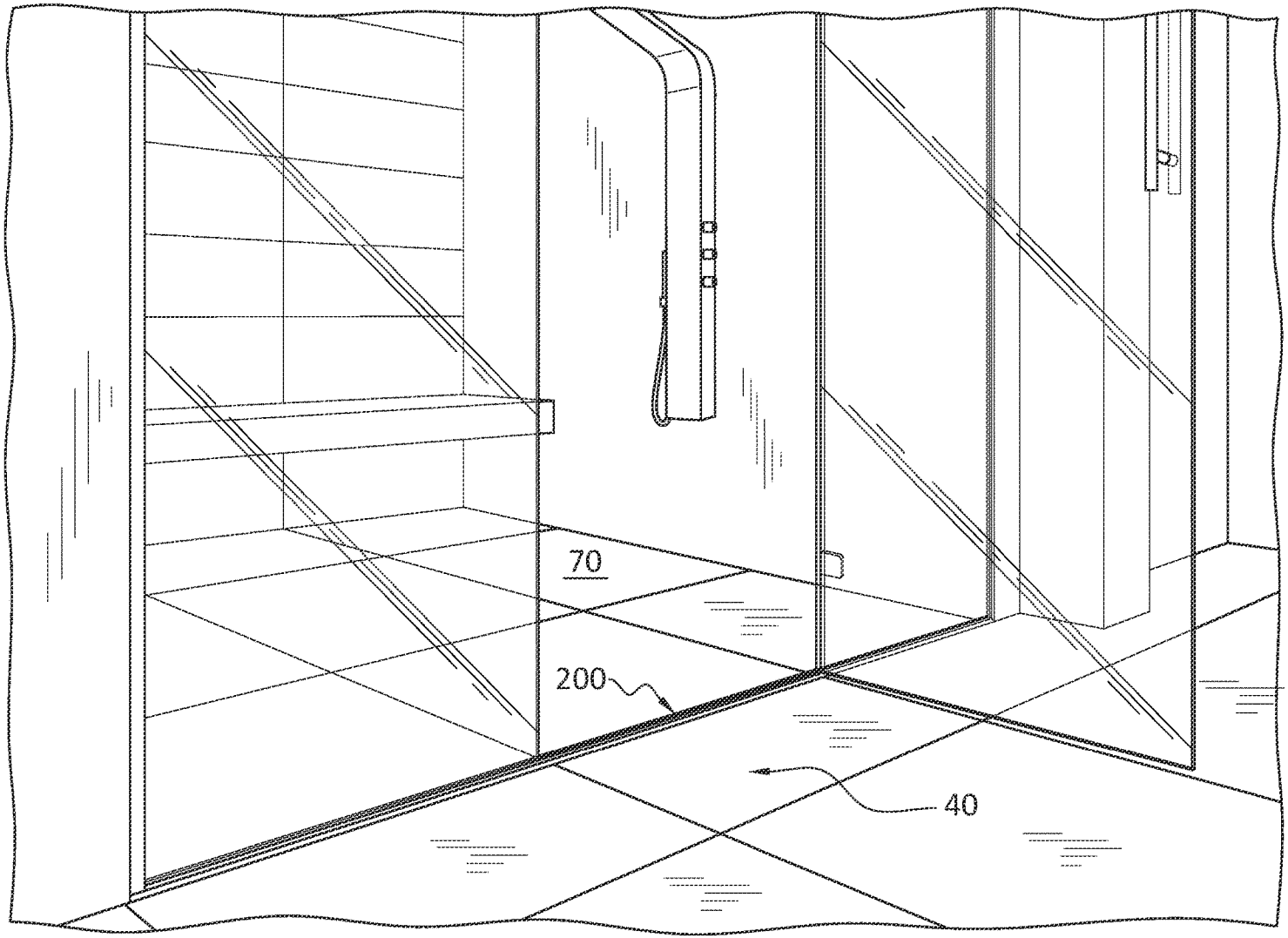
FIG. 9 shows an installation of the shower curb system of FIG. 7 in a shower floor.
Figure 10:
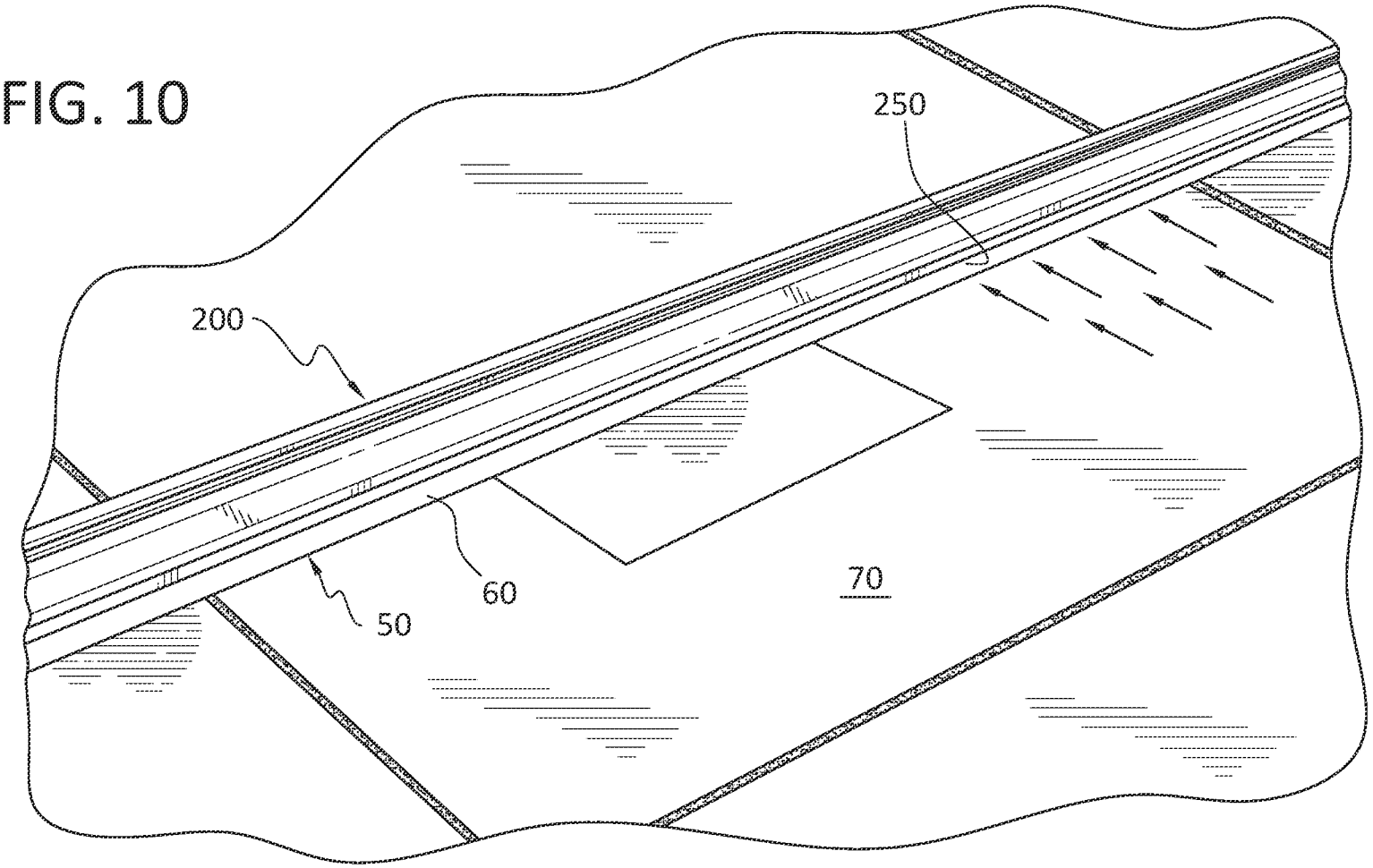
FIG. 10 shows a close-up view of the shower curb system installation of FIG. 9.

FIGS. 9 and 10 illustrate an exemplary installation of the shower curb system 200 in a shower area 40 in combination with a linear drain 50 including a slotted inlet 60. The shower area 40 can include tile and stone flooring. As seen best in FIG. 10, the shower curb system 200 can be installed such that the containment features 250 track or shadow the slotted inlet 60 of the linear drain 50. This arrangement helps obscure the slotted inlet 60 within the shower floor 40, improving the aesthetics of the shower floor 40. It also helps contain water within the wet floor area 70 of the shower floor 40 as the containment features 250 deflect water flowing towards the shower curb system 200 (designated by arrows in FIG. 10) back toward the slotted inlet 60 and the wet floor area 70 and remove energy from the water as it strikes the curb member 204. It will be appreciated that the shower floor 40 can be constructed of stone, tile, concrete, or any other suitable material.

Figure 11:
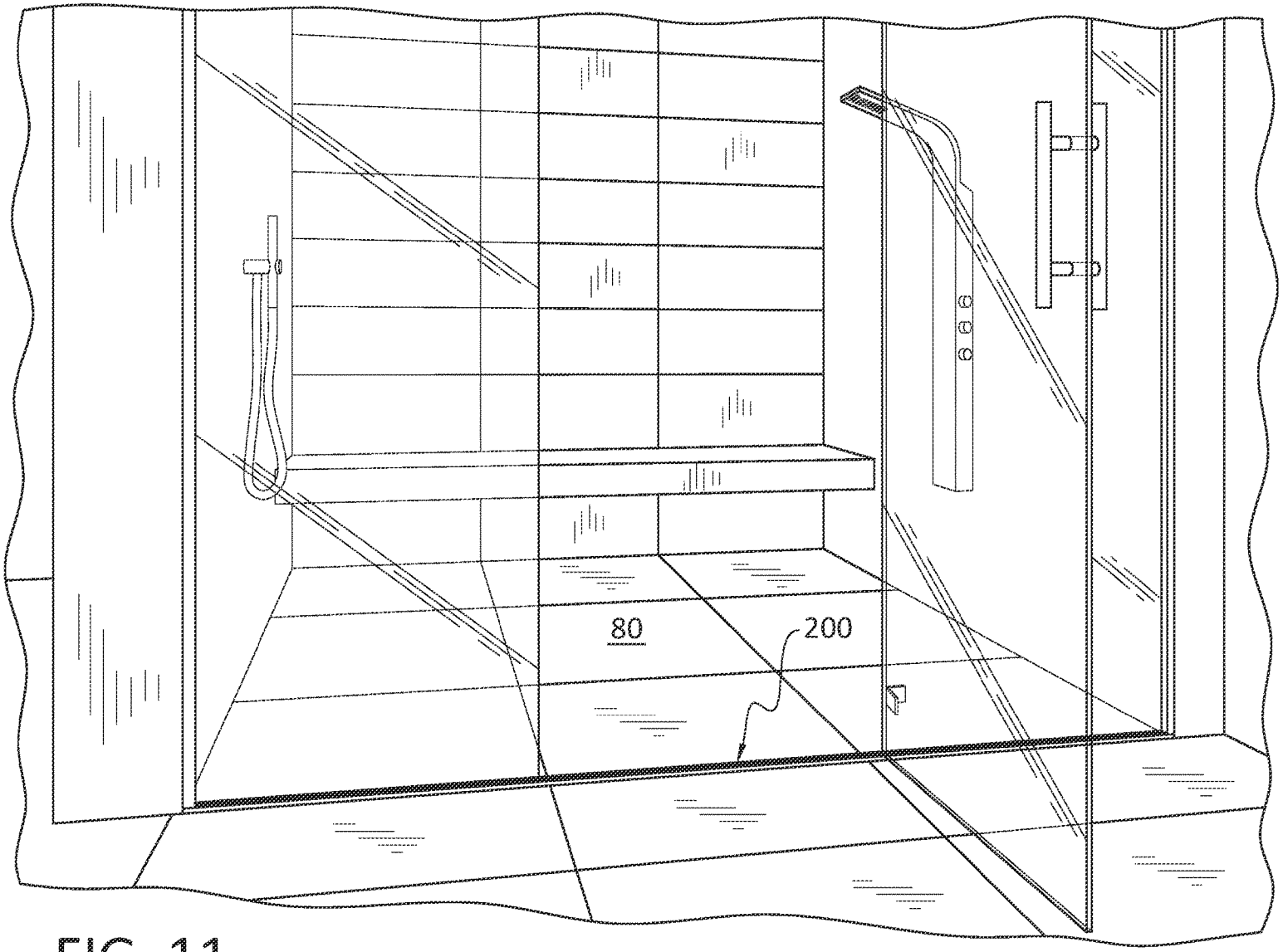
FIG. 11 shows another installation of the shower curb system of FIG. 7 in a shower floor.
Figure 12:
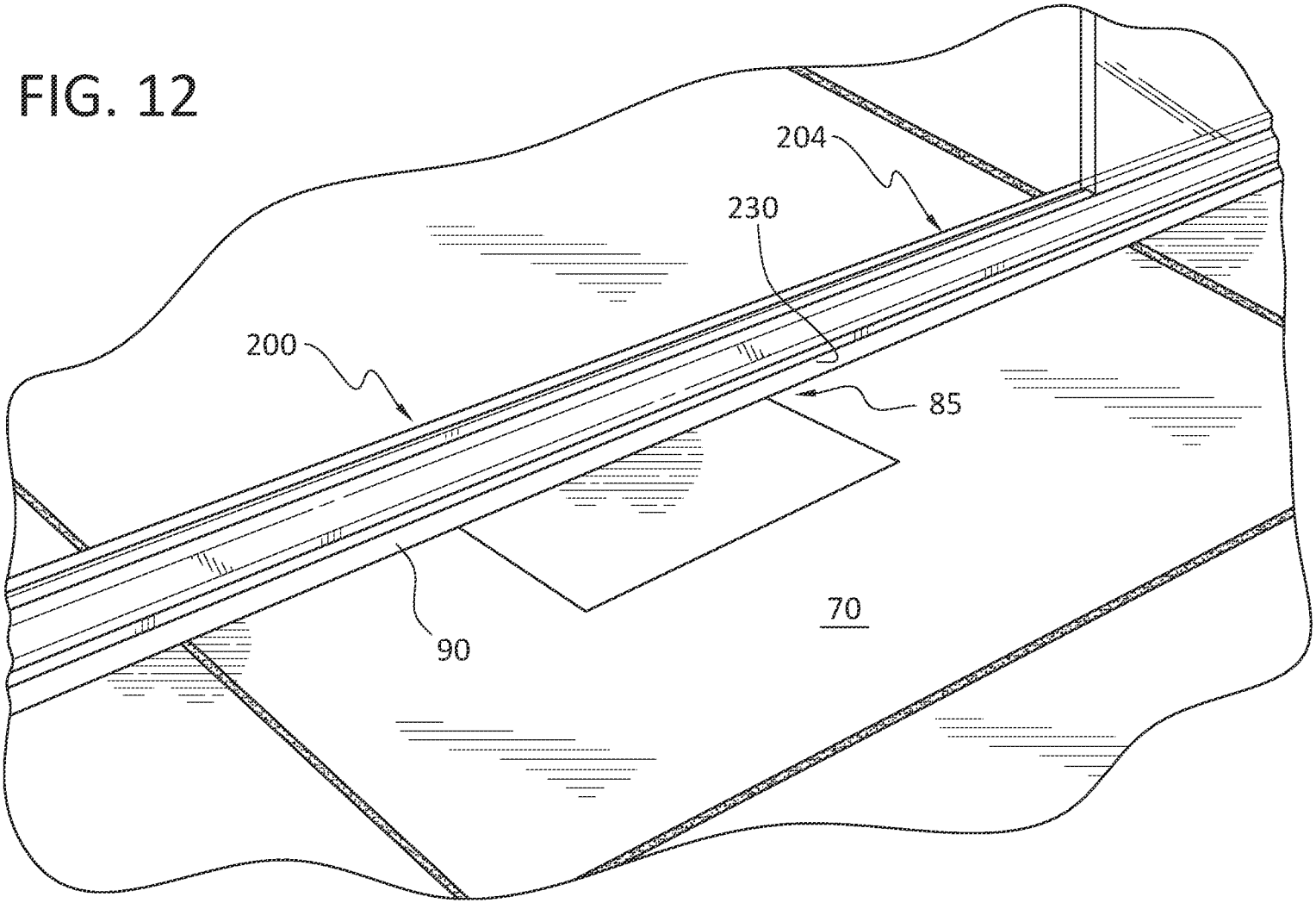
FIG. 12 shows a close-up view of the shower curb system installation of FIG. 10.

FIGS. 11 and 12 illustrate yet another exemplary installation of the shower curb system 200 in a shower area 80 in combination with a linear drain 85 including a slotted inlet 90 running along the first side 230 of the curb member 204.

It should be noted that the configuration of a front wall drain as in FIGS. 9-12 requires that a wet floor area 70 and/or a shower floor 80 be sloped toward the front wall drain. The raised shower curb system of current embodiments accordingly realizes the advantage that the height of the curb member 104 and the anchor member 102 may be configured to provide more height to a shower door, allowing the shower door to swing without hitting the sloped floor of the wet area of the shower. This eliminates the need to restructure a wood subfloor in a wet area because a drainage slope can be built on top of the subfloor rather than requiring to drop the subfloor as with known shower curb systems.

Methods for installing a shower curb system in a shower area according to the present disclosure may include attaching an anchor member 102 to a subfloor. In the step of attaching the anchor member 102 to the subfloor, fasteners may be provided through a plurality of openings 108 defined in the anchor member 102 to secure the anchor member 102 to the subfloor in the shower area entry or exit.

In another step, a curb member 104 may be provided on the anchor member 102, and may secure thereto for example by means of a snap fit connection or the like. The attachment between the curb member 104 and the anchor member 102 can be reversible or irreversible. In an embodiment, to remove the curb member from the anchor member 102, a force can be applied to the curb member 104 that overcomes the engagement between one or more snap lock features. The curb member 104 beneficially streamlines installation of a shower floor (e.g., tile or stone) because an installer does not need to frame and tile the shower curb. It also advantageously reduces the likelihood of leaks and water damage because the curb member 104 does not experience the same dimensional changes as prior art shower curbs that have been framed and tiled.

The disclosed methods may further comprise providing a cap member 106 and one or more glass members 148 to a top opening 112 of the curb member 104. Because the glass members 148 integrate with the curb member 104, the curb member 104 centers the glass members 148 relative to the curb member 104 and the glass members 148 cannot detach from a top of the curb member 104. This advantageously helps avoid installation errors and better supports the glass members 148 in a shower. It will be appreciated that the cap member 106 can be selectively sized to fit in the top opening 112 adjacent the glass members 148, covering the top opening 112 beyond the glass members 148. The cap member 106 can have a length L that is preconfigured and or can be cut to length at a job site.

As illustrated above, the shower curb systems and related methods of the present disclosure provide improved positioning and attachment of a shower curb and one or more glass members in a shower area. The disclosed embodiments provide a shower curb system that is more accurate and more efficient in installation, more durable, more waterproof, and less prone to failure than prior art systems, such as prior art systems requiring a tiled shower curb.

The various aspects and embodiments disclosed herein are for purposes of illustration and are not intended to be limiting. While the disclosure is described as used in a shower area, it will be appreciated the shower curb system can be used in other suitable wet floor areas. It will be appreciated that the shower curb system of the present disclosure can include any of the features described herein. Moreover, methods of installing the shower curb system of the present disclosure can include any of the steps or actions described herein. Additionally, the words "including," "having," and variants thereof (e.g., "includes" and "has") as used herein, including the claims, shall be open ended and have the same meaning as the word "comprising" and variants thereof (e.g., "comprise" and "comprises").

The invention claimed is:

1. A shower curb system for installation in a shower area, the shower curb system comprising:

a curb member installable in the shower area and arranged to form a flow barrier between a wet floor area and a dry floor area of the shower area, the curb member defining an internal cavity including a top opening and configured to receive one or more glass members via the top opening such that the curb member at least in part locates and supports the one or more glass members in the shower area; and a cap member removably positionable in the top opening.

2. The shower curb system of claim 1, wherein the cap member defines a peak configured for centering under a shower door when the shower door is closed so that an interface between the shower door and the cap member prevents water from passing outside of the wet area to the dry area.

3. The shower curb system of claim 2, wherein the cap member is configured to fit in the top opening adjacent the one or more glass members such that the cap member covers the top opening beyond the one or more glass members.

4. The shower curb system of claim 1, wherein the curb member further comprising one or more side openings providing fluid communication between the internal cavity and the wet floor area.

5. The shower curb system of claim 4, further comprising one or more longitudinal channels within the internal cavity configured to direct fluid that enters the internal cavity toward the one or more side openings for draining the curb member.

6. The shower curb system of claim 1, wherein the internal cavity includes one or more stabilizing features configured to help maintain the one or more glass members toward vertical when the one or more glass members are installed in the internal cavity.

7. The shower curb system of claim 1, wherein the curb member includes a first side arranged to interface with the wet floor area and a second side opposite the first side, the first side having one or more containment features configured to at least in part conceal or obscure a drain opening in the wet floor area.

8. The shower curb system of claim 7, wherein the one or more containment features comprise a lower portion having a planar configuration and an upper portion extending away from the lower portion toward the wet floor area.

9. The shower curb system of claim 8, wherein the upper portion comprises a curved overhang.

10. The shower curb system of claim 8, wherein the one or more containment features deflect water that runs up the first side back toward the wet floor area.

11. The shower curb system of claim 1, further comprising:

an anchor member arranged for attaching the curb member to a subfloor in the shower area.

12. The shower curb system of claim 11, wherein the curb member includes a bottom opening to accommodate the anchor member, the bottom opening being fluidically isolated from the internal cavity.

13. The shower curb system of claim 11, further comprising a locking system for attaching the curb member to the anchor member when the curb member is positioned on the anchor member.

14. The shower curb system of claim 13, wherein the locking system comprises one or more snap lock features.

15. The shower curb system of claim 14, wherein the one or more snap lock features comprise a plurality of hook portions defined on the curb member arranged to interact with one or more recesses defined on the anchor member to secure the curb member to the anchor member.

16. A shower curb system for installation in a shower area, the shower curb system comprising:

an anchor member arranged for attachment to a subfloor;

a curb member installable on the anchor member to selectively lock the curb member to the anchor member, the curb member arranged to form a flow barrier between a wet floor area and a dry floor area of the shower area, the curb member defining an internal cavity having a top opening and configured to receive one or more glass members via the top opening such that the curb member at least in part locates and supports the one or more glass members in the shower area; and a cap member removably positionable in the top opening, wherein the cap member is configured to fit in the top opening adjacent the one or more glass members such that the cap member covers the top opening beyond the one or more glass members.

17. The shower curb system of claim 16, wherein the curb member includes a bottom opening to accommodate the anchor member, the bottom opening being fluidically isolated from the internal cavity.

18. The shower curb system of claim 16, wherein the cap member defines a peak configured for centering under a shower door when the shower door is closed so that the shower door and the cap member interface to prevent water from passing outside of the wet area to the dry area.

19. The shower curb system of claim 16, wherein the internal cavity includes a stabilizing arm extending from a first side of the curb member and a blocking wall extending upward from a bottom of the internal cavity.

20. A method of installing a shower curb system, the method comprising:

installing a curb member in a shower area, the curb member defining an internal cavity having a top opening and forming a flow barrier between a wet floor area and a dry floor area of the shower area;

positioning one or more glass members in the internal cavity via the top opening such that the curb member at least in part locates and supports the one or more glass members in the shower area; and removably positioning a cap member in the top opening adjacent to the one or more glass members such that the cap member covers the top opening beyond the one or more glass members.

* * * * *